US006969116B2

(12) United States Patent
Machael et al.

(10) Patent No.: US 6,969,116 B2
(45) Date of Patent: Nov. 29, 2005

(54) CHAIR WITH BACKWARD AND FORWARD PASSIVE TILT CAPABILITIES

(75) Inventors: Jay R. Machael, Muscatine, IA (US); Marcus C. Koepke, Indianapolis, IN (US)

(73) Assignee: HNI Technologies Inc., Muscatine, IA (US)

( * ) Notice: Subject to any disclaimer, the term of this patent is extended or adjusted under 35 U.S.C. 154(b) by 3 days.

(21) Appl. No.: 10/749,008

(22) Filed: Dec. 30, 2003

(65) Prior Publication Data

US 2005/0146184 A1 Jul. 7, 2005

(51) Int. Cl.[7] ..... A47C 1/06

(52) U.S. Cl. ..... 297/300.2; 297/316; 297/320; 297/340

(58) Field of Search ..... 297/300.2, 300.4, 297/316, 320, 340

(56) References Cited

U.S. PATENT DOCUMENTS

| | | | | |
|---|---|---|---|---|
| 4,270,797 | A * | 6/1981 | Brauning | 297/300.3 |
| 4,411,469 | A | 10/1983 | Drabert et al. | |
| 4,732,424 | A * | 3/1988 | Uredat-Neuhoff | 297/317 |
| 4,789,203 | A * | 12/1988 | van Zee et al. | 297/300.1 |
| 4,848,837 | A | 7/1989 | Volkle | |
| 5,308,145 | A | 5/1994 | Koepke et al. | |
| 5,354,120 | A | 10/1994 | Volkle | |
| 5,605,376 | A | 2/1997 | Kogai | |
| 6,283,548 | B1 | 9/2001 | Husemann | |
| 6,349,992 | B1 * | 2/2002 | Knoblock et al. | 297/300.2 |
| D463,144 | S | 9/2002 | Pennington et al. | |
| 6,523,898 | B1 * | 2/2003 | Ball et al. | 297/320 |
| 6,572,190 | B2 * | 6/2003 | Koepke et al. | 297/284.1 |
| 6,709,058 | B1 * | 3/2004 | Diffrient | 297/320 |
| 6,817,667 | B2 * | 11/2004 | Pennington et al. | 297/284.4 |
| 2002/0041118 | A1 * | 4/2002 | Howell | 297/300.2 |
| 2002/0149247 | A1 | 10/2002 | Diffrient | |
| 2002/0171276 | A1 | 11/2002 | Bock | |
| 2002/0171277 | A1 | 11/2002 | Bock | |
| 2002/0190553 | A1 | 12/2002 | Koepke et al. | |

FOREIGN PATENT DOCUMENTS

| | | |
|---|---|---|
| EP | 0114600 | 8/1984 |
| FR | 2533428 | 3/1984 |

* cited by examiner

*Primary Examiner*—Peter M. Cuomo
*Assistant Examiner*—Joseph Edell
(74) *Attorney, Agent, or Firm*—Jones Day

(57) ABSTRACT

A chair with backward and forward passive tilt capabilities including a seat assembly, a back assembly, a frame assembly, a wheeled base, a pedestal and a tilt mechanism. The tilt mechanism includes first, second and third links, first, second, third and fourth pivot pins, brackets and a resilient deformable block. The first link connects the back assembly with the frame assembly by way of the first pivot pin and the seat assembly by way of the second pivot pin. The second link connects to the frame assembly with the third pivot pin and to the third link with the fourth pivot pin. When a chair occupant shifts his/her weight rearwardly to tilt the back assembly, the seat assembly lifts and the block is deformed and stressed. When the chair occupant leans forwardly, the seat assembly lowers and the back assembly tilts forwardly. Again, the block deforms. Once the occupant sits upright or leaves the chair, the deformed block induces a return force to place the chair in a neutral upright position.

10 Claims, 7 Drawing Sheets

CHAIR WITH BACKWARD AND FORWARD PASSIVE TILT CAPABILITIES

BACKGROUND OF THE INVENTION

Cross Reference to Priority Applications

Not applicable.

STATEMENT REGARDING FEDERALLY SPONSORED RESEARCH

Not applicable.

1. Field of the Invention

The present invention relates to a chair with backward and forward tilt capabilities and more particularly, to a synchronous office chair with passive backward and forward tilt capabilities, which chair is simply constructed, reliable and relatively inexpensive.

2. Description of the Related Art

Many chairs, particularly office chairs, have weight activated backward tilt. By this it is meant that a user shifting his or her weight is able to tilt the back portion of the chair to a reclining position. When the user shifts his/her weight back to an upright posture, or when the user departs, the chair returns to its neutral position on its own. This phenomenon is often described as being "passive". When the user shifts his/her weight forward, a spring returns the back portion of the chair to its upright position. Some office chairs are arranged so that the seat portion also moves in response to tilting of the back portion and is commonly referred to as being synchronous. Sometimes the seat portion is fixed to the back portion so that they pivot about the same angle and in other chairs the seat portion is arranged to be lowered or raised at a different rate than the rate of decline of the back portion resulting in different angular movements of the back portion and the seat portion.

BRIEF SUMMARY OF THE INVENTION

What is described here is a chair having synchronous movement of back and seat assemblies with backward and forward passive tilt capabilities comprising a chair having a seat assembly, a back assembly, a frame assembly for supporting the seat assembly and the back assembly, a base and a pedestal mounted to the base and connected to the frame assembly, a first link operatively connected to the back assembly, to the frame assembly and to a third link, a first pivot connected to the frame assembly and to the first link wherein the first link is pivotal relative to the frame assembly, a second pivot connected to the first link and to the seat assembly, a second link operatively connected to the frame assembly and to a third link, a third pivot connecting the frame assembly and the second link, a third link operatively connected to the seat assembly and to the second link, a fourth pivot connected to the second link and to the third link, and a biasing member mounted to the frame assembly and being deformable upon tilting of the chair.

There are a number of advantages, features and objects achieved with the present invention which are believed not to be available in earlier related devices. For example, one advantage is that the present invention provides for a synchronous chair apparatus that is arranged to allow both passive forward and passive backward tilting of the chair. Other objects of the present invention are the provision of a chair with forward and backward tilt capabilities which is simply constructed and reliable. Further advantages of the present invention are that the backward and forward tilt chair described here is relatively inexpensive, easy to construct and efficient to assemble.

Yet another advantage of the passive chair is that tilting movement of the chair is derived from a user's shifting of his/her body weight and the chair moves in a synchronous fashion, namely tilting of the back assembly causes a pivot of the seat assembly but at a different rate.

A more complete understanding of the present invention and other objects, advantages and features thereof will be gained from a consideration of the following description of preferred embodiments read in conjunction with the accompanying drawing provided herein. The preferred embodiments represent examples of the invention which is described here in compliance with Title 35 U.S.C. section 112 (first paragraph), but the invention itself is defined by the attached claims.

DETAILED DESCRIPTION OF A PREFERRED EMBODIMENT OF THE INVENTION

Figure 1:
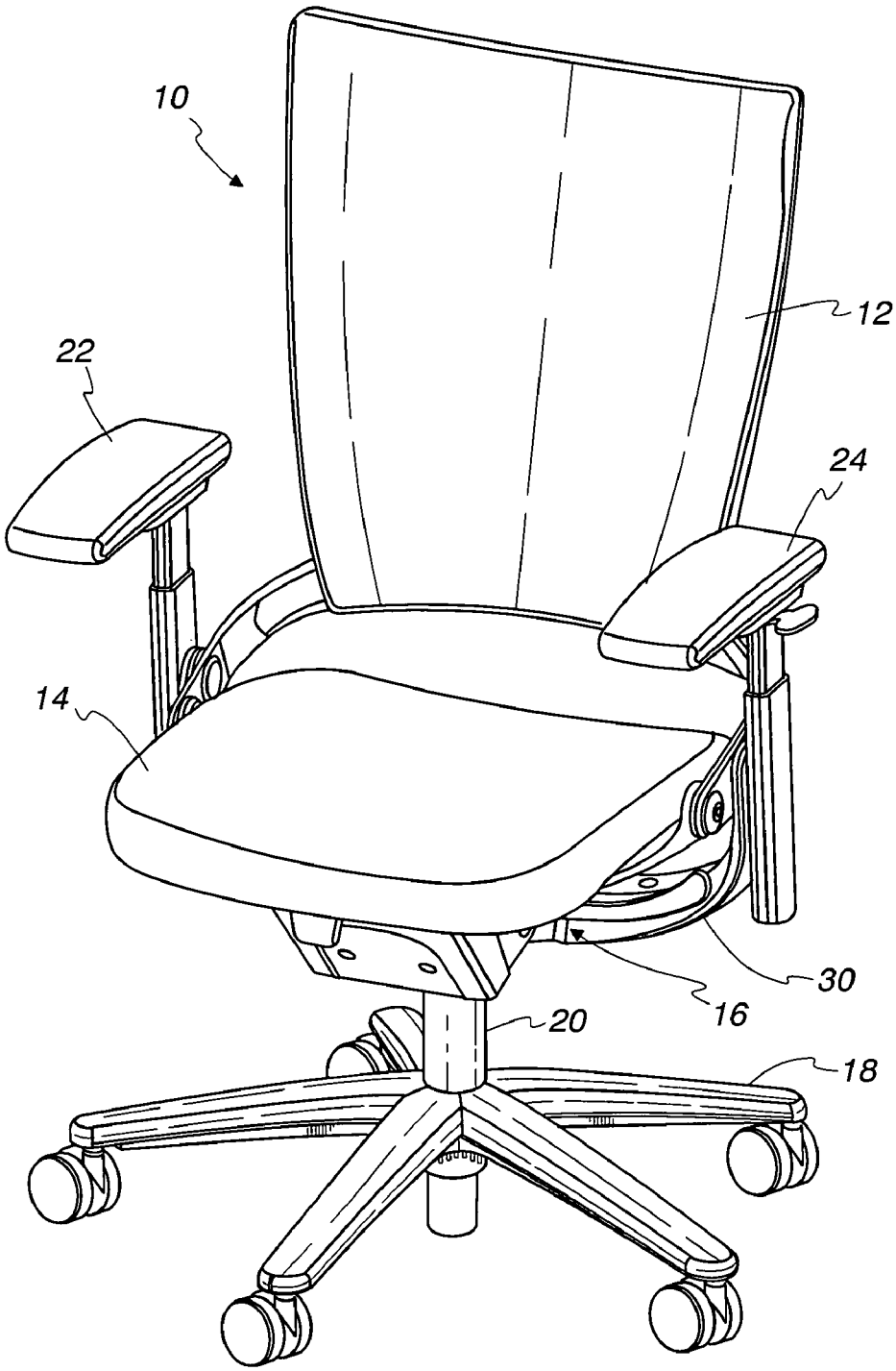
FIG. 1 is a front isometric view of a synchronous office chair having a passive forward and rearward tilt capability.

While the present invention is open to various modifications and alternative constructions, the preferred embodiment shown in the various figures of the drawing will be described herein in detail. It is understood, however, that there is no intention to limit the invention to the particular embodiment, form or example which is disclosed here. On the contrary, the intention is to cover all modifications, equivalent structures and methods, and alternative constructions falling within the spirit and scope of the invention as expressed in the appended claims, pursuant to Title 35 U.S.C. section 112 (second paragraph).

Figure 2:
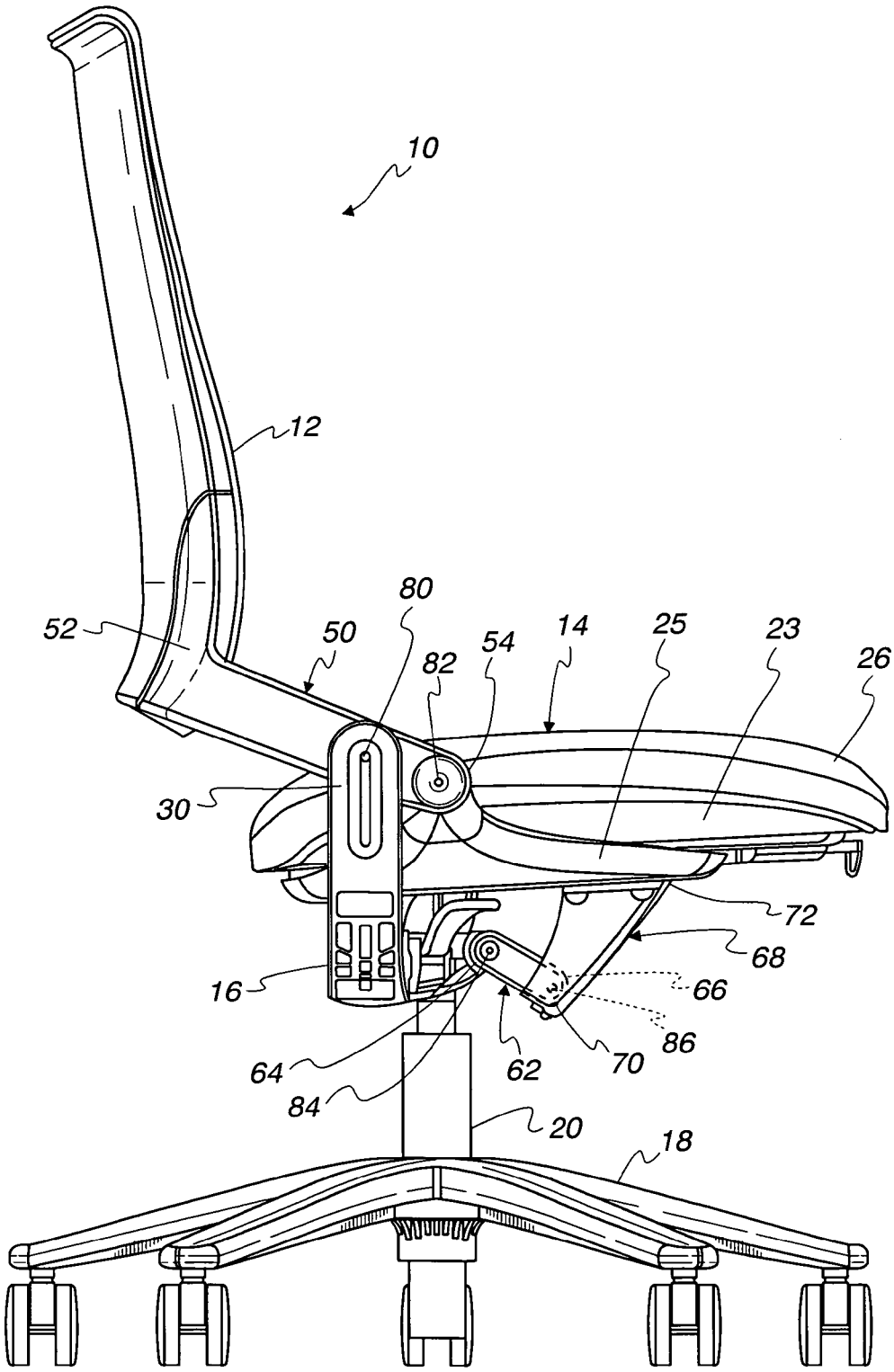
FIG. 2 is a side elevation view of the office chair shown in FIG. 1 but with armrest assemblies removed.

Referring now to FIGS. 1 and 2, there is illustrated an office chair 10. The chair has passive tilt capability and synchronous movement of seat and back and is weight activated. In FIG. 2 the chair is without armrest assemblies for greater clarity. The office chair includes a back assembly 12, a seat assembly 14, a frame assembly 16, a base with casters 18 and an adjustable pedestal 20. The chair also includes a pair of armrests 22, 24. The seat assembly 14 includes a seat pan 23, a seat plate 25 and a seat cushion 26. The frame assembly includes a yoke 30, FIGS. 1 and 3, a hub 32, control handles 34, 36 and a tilt lock mechanism 38, 40.

The office chair operates in the usual fashion in that the back assembly may be tilted or reclined, and the frame assembly may be vertically adjusted so as to allow a user to select a comfortable height for the seat assembly. The chair also provides for synchronous movement of the back and seat assemblies. Thus, when a chair user leans rearwardly, not only does the back assembly recline, but the seat assembly also pivots in a predetermined relationship. The inventive chair disclosed here also passively tilts rearwardly and forwardly.

Reference is made to co-pending patent applications assigned to the same assignee as the present application and entitled Horizontally Adjustable Chair Armrest, application Ser. No. 10/748,537, filed Dec. 30, 2003; Chair Back, application Ser. No. 10/750,573, filed Dec. 30, 2003; Vertically Adjustable Chair Armrest, application Ser. No. 10/749,010, filed Dec. 30, 2003; Chair With Adjustable Seat Back, application Ser. No. 10/748,079, filed Dec. 30, 2003. These applications disclose other features of the chair. All disclosures of the Applications just mentioned are incorporated herein by reference.

Figure 3:
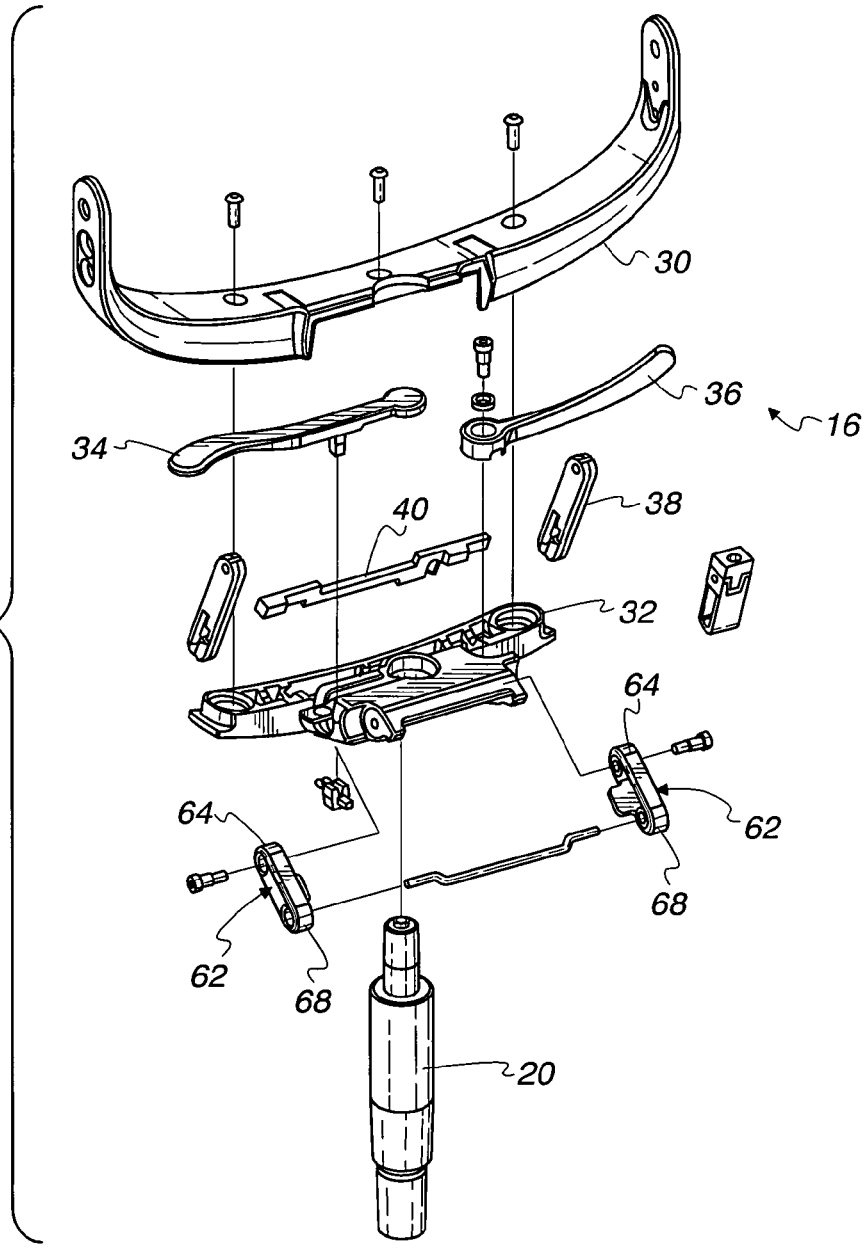
FIG. 3 is an exploded isometric view of a frame assembly, a link and a pedestal of the office chair shown in FIGS. 1 and 2.

The mechanism for allowing the chair 10 to tilt rearwardly as well as forwardly in an efficient manner will be best understood by reference to FIGS. 2 and 3. The mechanism includes a first link 50 forming at one end portion 52 part of the back assembly 12, pivotally connected at the other end portion 56 to the seat plate 25 and also pivotally connected between the two end portions to the frame assembly 16, specifically the yoke 30. A second link 62 has one end portion 64 pivotally connected to the frame assembly 16, specifically the hub 32, and the other end portion 66 to a third link 68. The third link 68 in turn has one end portion 70 pivotally connected to the second link 62 and the other end portion 72 fixed to the seat plate 25.

A first pin 80 forms a first pivot and pivotally connects the mid-portion of the first link 50 to the frame 16. Another pin 82 forms a second pivot and pivotally connects the seat assembly 14 to the first link 50. A third pin 84 forms a third pivot and pivotally connects the frame assembly 16 and the one end portion 64 of the second link 62. A fourth pin 86 forms a fourth pivot and pivotally connects the one end portion 70 of the third link 68 to the other end portion 66 of the second link 62. The first pivot pin 80 is located more rearwardly and upwardly than the second, third and fourth pivot pins 82, 84, 86, the second pivot pin 82 is located more rearwardly and upwardly than the third and fourth pivot pins 84, 86 and the third pivot pin 84 is located more rearwardly and upwardly than the fourth pivot pin 86.

The mechanism also includes a biasing member in the form of a rubber block 90, FIGS. 4–7. The block is between the second links 62 with one end portion attached to the frame assembly which is thus fixed, and the other end portion attached to the third links which is movable with pivoting of the seat assembly.

Figure 4:
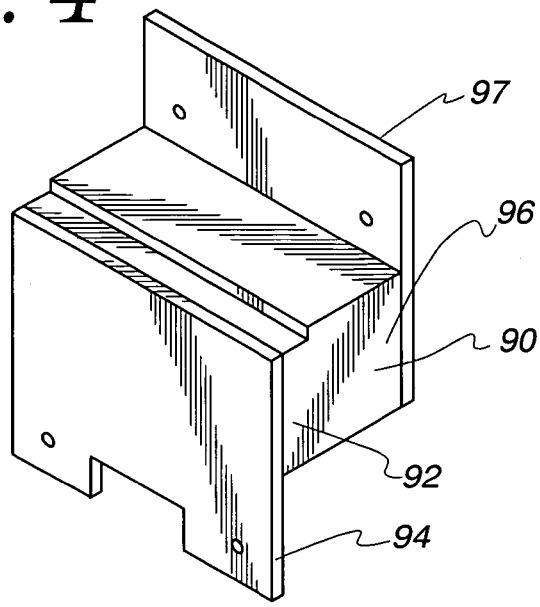
FIG. 4 is an isometric view of a resilient block and end brackets.
Figure 5:
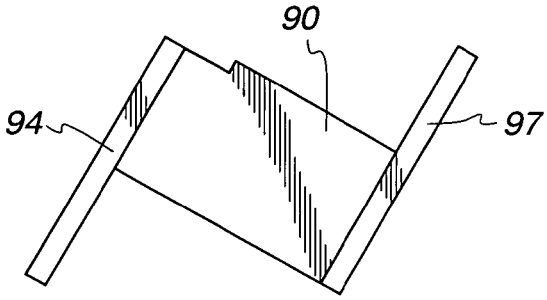
FIG. 5 is a diagrammatic elevation view of the resilient block in a neutral position.

The second link includes spaced parallel bars (FIG. 3) surrounding biasing member 90 which is deformable. When deformed a stress is induced in the block to return itself to the unstressed position. In the illustrative embodiment, the biasing member is the block of resilient material formed of rubber. Any suitable material may be used provided it acts rubberlike. As shown in FIGS. 4 and 5, the block has a neutral, unstressed position when the chair is positioned as shown in FIG. 2. When deformed under an applied force, such as a weight shift of a chair user, the block develops a counter force due to stress which tends to bias the block and thereby the chair back to their neutral positions.

It will be understood that other energy generating devices may be used, such as a leaf spring, a torsion spring or the like. Rubber or rubberlike material is preferred however because of rubber's damping characteristics, its ease of attachment to the chair, its noiselessness and its ability to sustain large deformations because it is highly elastic. Rubber also has the advantages of durability and high energy relative to size or volume. Thus, the block is compact.

Figure 6:
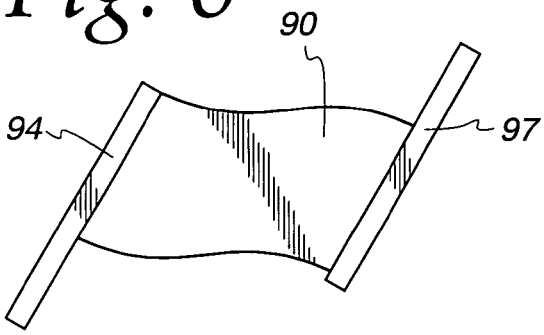
FIG. 6 is an exaggerated diagrammatic elevation view of the resilient block in an upward stressed position.
Figure 7:
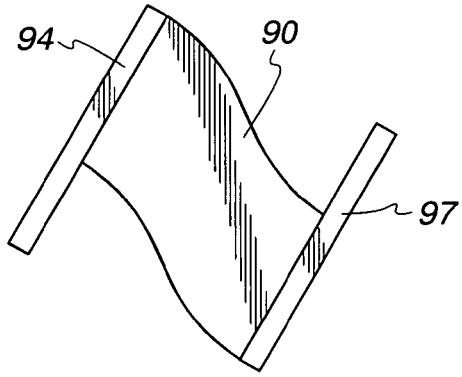
FIG. 7 is an exaggerated diagrammatic elevation view of the resilient block in a downward stressed position.

A first end portion 92 of the resilient block 90 is attached to a fixed bracket 94 which is attached to the frame assembly 16 and the other end portion 96 of the resilient block is connected to a bracket 97 which is connected to the third link 68. When the second and third links move in response to rearward or forward tilt of the back assembly and synchronous movement of the seat assembly due to a chair user shifting his/her weight in the chair, the resilient block is deformed thereby setting up a biasing force seeking to return the block to its unstressed, neutral position. When a user moves back against the back assembly, the block distorts as shown in FIG. 6. When the user moves forward the block distorts as shown in FIG. 7. When the user shifts his/her weight back toward a neutral or upright position or when the user departs from the chair, the resilient block will return the chair to its upright position. The actual force induced in the block is a function of the block's material, the block's geometry and the block's hardness.

To better understand the operation of the office chair, it should be understood that the frame assembly 16 is stationary in use after being adjusted vertically to the comfort of a specific chair user. The first pivot pin 80 and the third pivot pin 84 which are mounted to the frame assembly to allow rotation of other elements but they themselves remain in fixed locations. The second pivot pin 82 and the fourth pivot pin 86, however, are arranged so that they each move in an arc in response to movement of the links to which they are attached.

Movement of the links and pivot pins causes the resilient block to deform or bend and thereby to distort as diagrammatically shown in FIGS. 6 and 7 as compared to a neutral position shown in FIGS. 4 and 5. Deformation of the resilient block 90 creates shear stress in the block which in turn creates a biasing force to return the block to its neutral position. It is this biasing force plus the arrangement of links and pivots which allow the chair to tilt rearwardly and forwardly in a passive arrangement simply by a chair user shifting his/her body weight.

Figure 8:
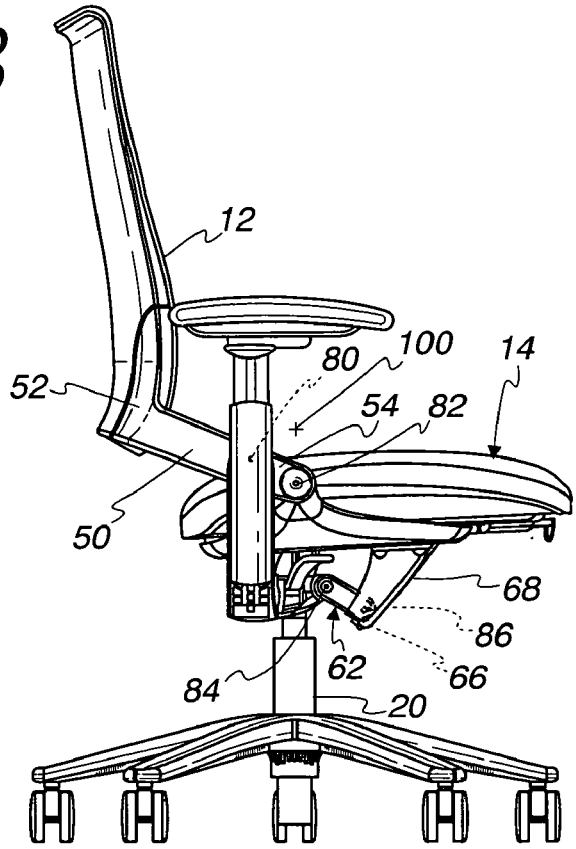
FIG. 8 is a side elevation view of the chair shown in FIG. 1 where the back assembly of the chair is in an upright or neutral position.
Figure 9:
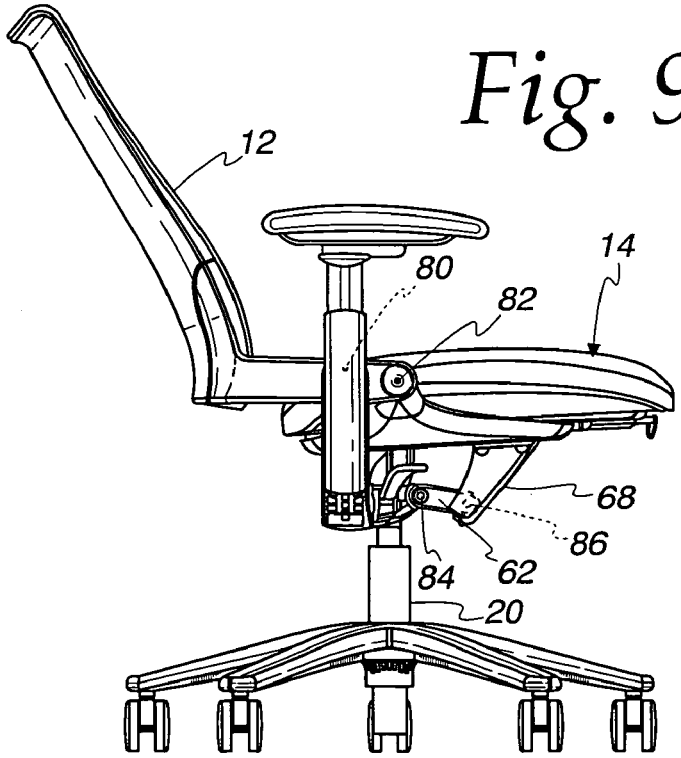
FIG. 9 is a side elevation view of the chair shown in FIG. 7 where the back assembly of the chair is fully reclined or tilted backwardly and the seat assembly is raised slightly.
Figure 10:
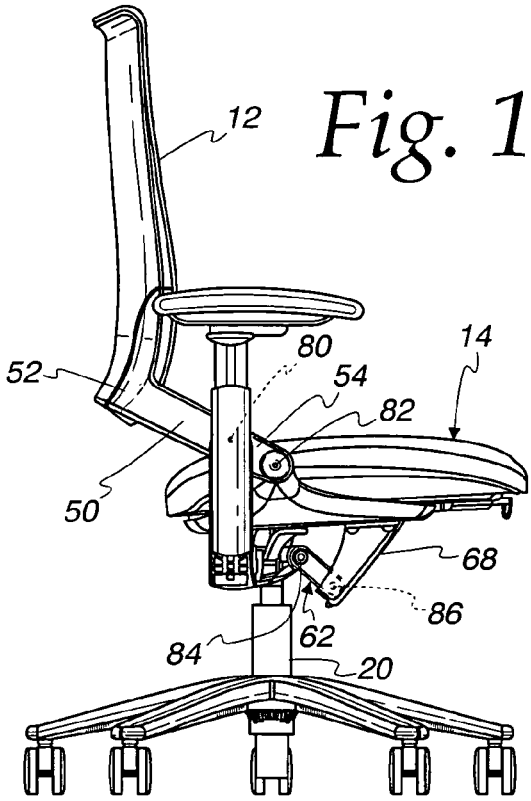
FIG. 10 is a side elevation view of the chair shown in FIGS. 7 and 8 where the back assembly is tilted in a forward direction and the seat assembly has been slightly lowered.

The passive tilting may be appreciated by reference to FIGS. 8–10. In FIG. 8, the chair 10 is shown in a neutral or upright position. In this position there is either no one occupying the chair or the chair user has not shifted his/her weight rearwardly or forwardly. Under such circumstances, the resilient block 90 has not been deformed so there is no shear stress induced in the block. A small cross 100 is drawn above the second pivot 82 and represents the approximate position of a chair user's hip joint.

Referring to FIG. 9, the chair 10 is in a position of recline which occurs when the chair occupant leans backwardly thereby forcing the back assembly to recline. It can be observed that when the chair back assembly is reclined, the first end portion 52 of the first link 50 which is connected to the back assembly 12 rotates counterclockwise or downwardly causing the opposite end portion 54 to pivot upwardly and thereby marginally raise the seat assembly. Raising the seat assembly causes the third link 68 to move upwardly which in turn pulls the fourth pivot pin 86 upwardly so that the end portion 66 of the second link 68 is raised. This movement also distorts the resilient block. In the neutral position (FIG. 8), the second link 62 is disposed at an angle of roughly twenty three degrees from a horizontal reference. This may be compared to the FIG. 9 disposition where the second link is disposed at about zero degrees from a horizontal reference. (The angles are measured from the third pivot pin 84.) Only a marginal lift of the seat assembly is desired so as to maintain the occupant's relative position to the floor or related work surface.

In the reclined position shown in FIG. 9, the resilient block is distorted as shown in FIG. 6 thereby inducing a biasing force to return the block and the chair to the positions shown in FIGS. 5 and 8, respectively. Such a return will occur once the chair user shifts his/her weight forwardly or departs from the chair.

In an analogous manner a user may lean forward in the chair, for example, while performing a computer task or writing or reading at a desk or other work surface. The forward tilt of the chair is shown in FIG. 10 where the front portion of the seat assembly is pivoted downwardly causing the third link 68 to push the fourth pivot pin 86 downwardly. This motion increases the angle of the second link 62 from a horizontal reference line to about forty degrees. The same forward rotation of the seat assembly causes the second pivot pin 82 to move downwardly causing the end portion 54 of the first link 50 to follow. Because the first link is pivoted to the frame assembly 16 by the first pivot pin 80, the downward motion of the end portion 54 of the first link causes the opposite end portion 52 to rise. This causes the back assembly to tilt forwardly. Hence, the chair follows the user in an automatic or passive way simply because the user has shifted his/her weight forwardly.

The forward tilt causes the resilient block to deform downwardly as shown in FIG. 7 which induces a biasing force to return the block to the neutral position shown in FIG. 5. Thus, as with the reclined position, once the user shifts his/her weight upwardly or if the user departs from the chair, the resilient block will return the chair to the neutral or upright position shown in FIG. 8.

Figure 11:
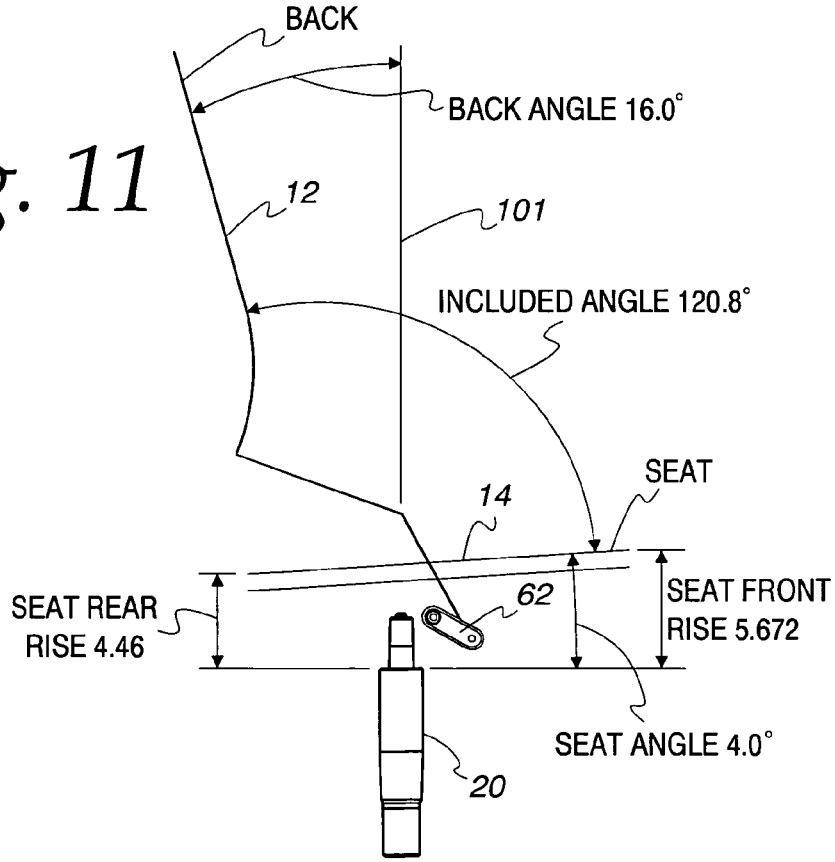
FIG. 11 is a kinematic elevation view of the chair of FIGS. 1, 7–9 in an upright or neutral position.
Figure 12:
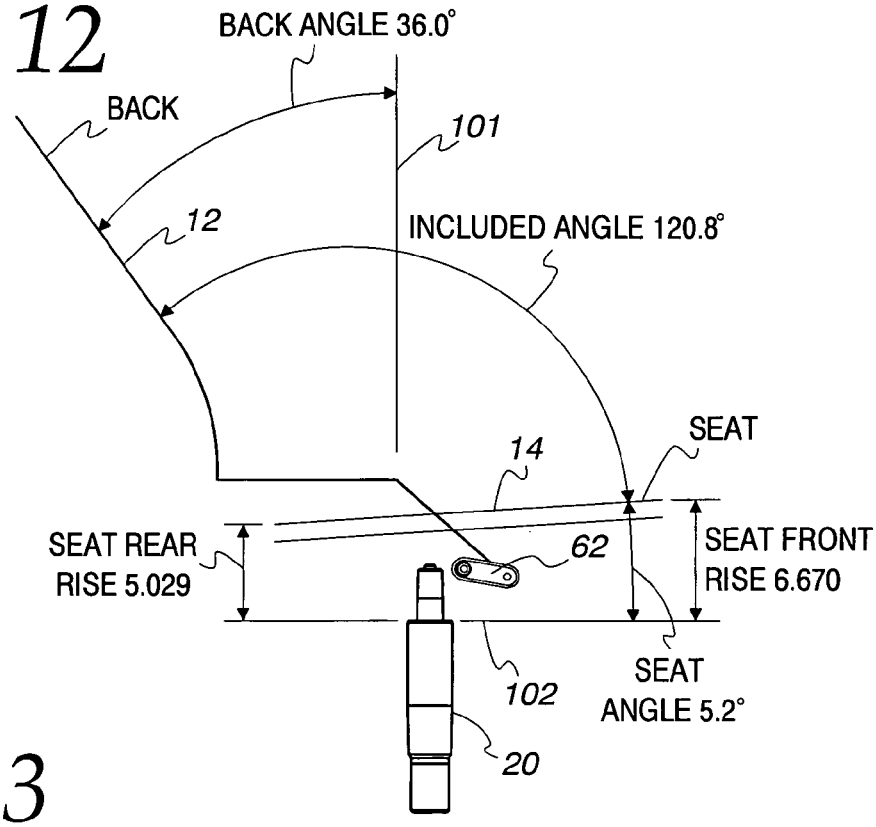
FIG. 12 is a kinematic elevation view of the chair of FIGS. 1, 7–9 in a full backward tilt.
Figure 13:
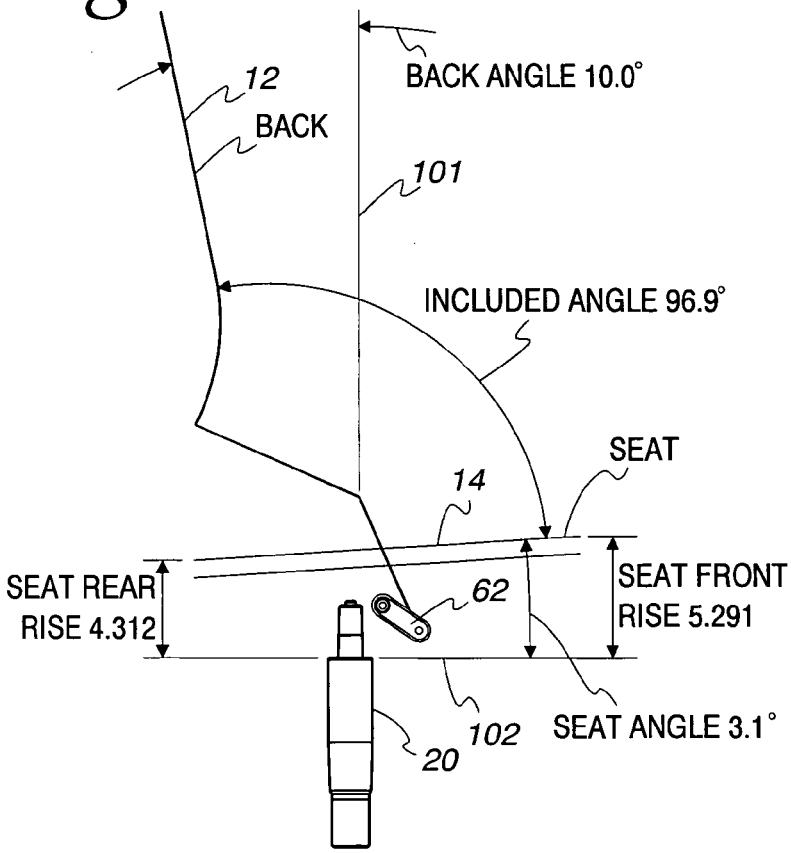
FIG. 13 is a kinematic elevation view of the chair of FIGS. 1, 7–9 in a forward tilt position.

Referring now to FIGS. 11–13, kinematic views of the chair are shown. The kinematic views are analogous to the chair views shown in FIGS. 8–10. The chair, when in the neutral position (FIG. 11), locates the back assembly 12 at an angle to a vertical reference line 101 of about sixteen degrees. The angle between the back assembly 12 and the seat assembly 14 is approximately one hundred and two degrees. In this disposition, the seat is angled at about four degrees from a horizontal reference line 102, the front of the seat has a rise of approximately 5.67 and the rear portion of the seat assembly has a rise of about 4.46. The second link 62 is disposed at an angle of about thirty five degrees from the horizontal reference line.

When the back assembly is reclined (FIG. 12), the back assembly 12 has an angle of about thirty six degrees from the vertical reference line 101, the angle between the back assembly 12 and the seat assembly 14 is about one hundred and twenty degrees and the seat assembly 14 has an angle of about five and one fifth degrees from the horizontal reference line 102. The front portion of the seat assembly has a rise of about 6.67 and the rear portion of the seat assembly has a rise of about 5.03. The angle of the second link 62 is about zero degrees from the horizontal reference line 102.

When the chair is tilted forward (FIG. 13), the back assembly 12 has an angle of about ten degrees from the vertical reference line 101 and the angle between the back assembly 12 and the seat assembly 14 is about ninety seven degrees. The seat angle is about three degrees from the horizontal reference line 102 with a seat front rise of about 5.29 and a seat rear rise of about 4.3. The second link 62 has an angle of about fifty five degrees from the horizontal reference line 102. More precise measurements are set forth in FIGS. 11–13 as to angles and rises.

The kinematic figures also show the synchronous movement of the chair. For example, a counterclockwise pivot of the back assembly of about twenty degrees, induces a synchronous pivot of about 1.2 degrees in the seat assembly. Similarly, a clockwise pivot of the back assembly by about six degrees induces a synchronous pivot of about two degrees in the seat assembly.

The preferred distance between the first and second pivot pins 80, 82 is about 2.25 inches and the distance between the third and fourth pivot pins 84, 86 is about 2.0 inches. In the neutral position, the first pivot pin 80 is about 0.50 inches above and 2.17 inches behind the second pivot pin 82, about 5.66 inches above and 3.58 inches behind the third pivot pin 84 and about 6.45 inches above and 5.42 inches behind the fourth pivot pin 86. The angle of the first link 50 is about fifteen degrees from a horizontal reference line and the angle of the second link 62 is about 23.2 degrees from a horizontal reference line.

In a full reclined position, the first pivot pin 80 is about the same height and 2.25 inches behind the second pivot pin 82, about 5.66 inches above and 3.58 inches behind the third pivot pin 84, and about 5.66 inches above and 5.58 inches behind the fourth pivot pin 86. The angle of the first link 50 is about zero degrees from a horizontal reference line and the angle of the second link 62 is also about zero degrees from a horizontal reference line.

In full forward tilt, the first pivot pin 80 is about 0.99 inches above and 2.02 inches behind the second pivot pin 82, about 5.66 inches above and 3.58 inches behind the third pivot pin 84, and about 6.93 inches above and 5.13 inches behind the fourth pivot pin 86. The angle of the first link 50 is about twenty six degrees from a horizontal reference line and the second link 62 is about 39.2 degrees from a horizontal reference line.

In operation of the chair, a neutral position is assumed by the chair when there are no distortions of the resilient block and thereby no biasing force induced into the chair mechanism. To recline, a user merely shifts his/her weight rearwardly causing the resilient block to be deformed as shown in FIG. 6. The user's hip joint 100 represents the pivot point for rearward or forward weight shifts. This induces a biasing force to return the chair to its neutral position once the user sits upright or leaves the chair. The same mechanism allows the user to tilt forwardly simply by leaning forward in the chair as he/she would do when performing a task at a desk. This forward movement of the user's weight causes the resilient block to be deformed as shown in FIG. 7 thereby inducing a biasing return force. Once again, when the user shifts his/her weight away from the desk, the chair will tend to return to its neutral position and will definitely return to its neutral position if the chair user leaves the chair. It may now be appreciated that the office chair has a mechanism which allows the chair to respond merely to the shifting of an occupant's weight to tilt backwardly or forwardly. In both cases once the weight is removed, the chair returns to its neutral position. It may also be appreciated that the mechanism for achieving this passive movement is relatively simple, very reliable and generally inexpensive.

The above specification describes in detail a preferred embodiment of the present invention. Other examples, embodiments, modifications and variations will, under both the literal claim language and the doctrine of equivalents, come within the scope of the invention defined by the appended claims. For example, the shape or design of the seat assembly and the back assembly may change and the chair will still be considered an equivalent structure. The length and location of the links and the locations of the pivot pins may also change somewhat and the chair will still be considered an equivalent structure and will still come within the literal language of the broadest claims even if angles and rises are somewhat altered. Yet other alternatives will also be equivalent as will many new technologies. There is no desire or intention here to limit in any way the application of the doctrine of equivalents nor to limit or restrict the scope of the invention.

What is claimed is:

1. A chair having synchronous movement of back and seat assemblies and backward and forward passive tilt capabilities comprising:

a chair having a seat assembly, a back assembly and a frame assembly for supporting said seat and said back assemblies;

a first link operatively connected to said back assembly, to said frame assembly and to said seat assembly;

a first pivot connecting said frame assembly and said first link wherein said first link pivots relative to said frame assembly;

a second pivot connecting said first link and said seat assembly wherein said first link pivots relative to said seat assembly, whereby said second pivot is approximately located beneath a chair occupant's hip joint;

a second link operatively connected to said frame assembly and to a third link;

a third pivot connecting said frame assembly and said second link;

said third link operatively connected to said seat assembly and to said second link;

a fourth pivot connecting said second link and said third link; and a biasing member mounted to said frame assembly and being deformable;

said first pivot is located more rearwardly and upwardly than said second, third and fourth pivots;

said second pivot is located more rearwardly and upwardly than said third and fourth pivots; and said third pivot is located more rearward and upwardly than said fourth pivot.

2. A chair having synchronous movement of back and seat assemblies and backward and forward passive tilt capabilities comprising:

a chair having a seat assembly, a back assembly and a frame assembly for supporting said seat and said back assemblies;

a first link operatively connected to said back assembly, to said frame assembly and to said seat assembly;

a first pivot connecting said frame assembly and said first link wherein said first link pivots relative to said frame assembly;

a second pivot connecting said first link and said seat assembly wherein said first link pivots relative to said seat assembly, whereby said second pivot is approximately located beneath a chair occupant's hip joint;

a second link operatively connected to said frame assembly and to a third link;

a third pivot connecting said frame assembly and said second link;

said third link operatively connected to said seat assembly and to said second link;

a fourth pivot connecting said second link and said third link; and a biasing member mounted to said frame assembly and being deformable;

said first pivot is fixed in position relative to said frame assembly;

said second pivot is movable relative to said frame assembly;

said third pivot is fixed in position relative to said frame assembly;

said fourth pivot is movable relative to said frame assembly;

said first pivot is located more rearwardly and upwardly than said second, third and fourth pivots;

said second pivot is located more rearwardly and upwardly than said third and fourth pivots; and said third pivot is located more rearward and upwardly than said fourth pivot.

3. The chair of claim 2 wherein:

from an upright position a weight shift by a chair occupant causes said seat assembly to tilt downwardly thereby tilting said back assembly forwardly toward said seat assembly; and from an upright position a weight shift by a chair occupant causes said back assembly to tilt rearwardly and said seat assembly to lift.

4. The chair of claim 3 wherein:

said seat assembly moves at a lesser rate than said back assembly.

5. The chair of claim 3 wherein:

movement of said back assembly causes said first link to move said seat assembly;

movement of said seat assembly pivots said second link; and pivoting said second link causes said biasing member to deform.

6. The chair of claim 5 wherein:

movement of said seat assembly induces stress in said biasing member.

7. The chair of claim 6 wherein:

movement of said seat assembly from an upright neutral position induces deformation of said biasing member and a biasing force to return said seat assembly to said upright neutral position.

8. The chair of claim 7 wherein:

said first link is connected at a first end portion to said back assembly, at a second end portion to said seat assembly and between said first and second end portions to said center frame; and said third link is connected at a first end portion to a front portion of said seat assembly and at a second end portion to said second link.

9. A chair having synchronous movement of back and seat assemblies and backward and forward passive tilt capabilities comprising:

a chair having a seat assembly, a back assembly and a frame assembly for supporting said seat and said back assemblies;

a first link operatively connected to said back assembly, to said frame assembly and to said seat assembly;

a first pivot connecting said frame assembly and said first link wherein said first link pivots relative to said frame assembly;

a second pivot connecting said first link and said seat assembly wherein said first link pivots relative to said seat assembly, whereby said second pivot is approximately located beneath a chair occupant's hip joint;

a second link operatively connected to said frame assembly and to a third link;

a third pivot connecting said frame assembly and said second link;

said third link operatively connected to said seat assembly and to said second link;

a fourth pivot connecting said second link and said third link; and a biasing member mounted to said frame assembly and being deformable;

wherein from an upright position a weight shift by a chair occupant causes said seat assembly to tilt downwardly thereby tilting said back assembly forwardly toward said seat assembly;

from an upright position a weight shift by a chair occupant causes said back assembly to tilt rearwardly and said seat assembly to lift;

movement of said back assembly causes said first link to move said seat assembly;

movement of said seat assembly pivots said second link;

pivoting said second link causes said biasing member to deform;

movement of said seat assembly induces stress in said biasing member;

movement of said seat assembly from an upright position induces deformation of said biasing member and a biasing force to return said seat assembly to said upright neutral position;

said first pivot is fixed in position relative to said frame assembly;

said second pivot is movable relative to said frame assembly;

said third pivot is fixed in position relative to said frame assembly;

said fourth pivot is movable relative to said frame assembly;

said first pivot is located more rearwardly and upwardly than said second, third and fourth pivots;

said second pivot is located more rearwardly and upwardly than said third and fourth pivots; and said third pivot is located more rearward and upwardly than said fourth pivot.

10. The chair of claim 9 wherein:

said first link is connected at a first end portion to said back assembly, at a second end portion to said seat assembly and between said first and second end portions to said frame assembly; and said third link is connected at a first end portion to a front portion of said seat assembly and at a second end portion to said second link.

* * * * *